United States Patent [19]

Bauer

[11] 4,196,857

[45] Apr. 8, 1980

[54] SPRAY NOZZLE FORMED IN CONTAINER CLOSURE

[76] Inventor: Peter Bauer, 13921 Esworthy Rd., Germantown, Md. 20767

[21] Appl. No.: 906,939

[22] Filed: May 18, 1978

[51] Int. Cl.[2] ..... B05B 1/02

[52] U.S. Cl. ..... 239/327; 239/393; 239/589

[58] Field of Search ..... 239/101, 102, 327, 393, 239/394, 589; 222/215

[56] References Cited

U.S. PATENT DOCUMENTS

| | | | |
|---|---|---|---|
| 2,997,243 | 8/1961 | Kolb | 239/394 X |
| 3,170,633 | 2/1965 | Castelli | 239/327 |
| 3,185,352 | 5/1965 | Ghisolfi | 239/327 X |
| 4,052,002 | 10/1977 | Stouffer et al. | 239/101 |

*Primary Examiner*—John J. Love

*Attorney, Agent, or Firm*—Griffin, Branigan & Butler

[57] ABSTRACT

A fluidic oscillator nozzle is formed in the top inside surface of a cap for a container of sprayable fluid and is sealed by a gasket which is urged against that surface when the container is pressurized. Alternatively, the nozzle may be formed in the gasket surface so that the inside surface of the cap serves the sealing function. The nozzle is particularly suitable for use with squeeze bottle type dispensers in that the nozzle does not require any additional parts.

10 Claims, 11 Drawing Figures

SPRAY NOZZLE FORMED IN CONTAINER CLOSURE

BACKGROUND OF THE INVENTION

The present invention relates to spray nozzles associated with containers of sprayable fluid. More particularly, the present invention relates to an improved fluidic oscillator nozzle having particular advantage when used with squeeze bottles.

Squeeze bottle dispensers, for example, of the type described in U.S. Pat. No. 3,963,150 (Steiman et al), are advantageous containers for many household sprayable fluids because they are inexpensive and convenient to use. Specifically, squeeze bottles do not require a special pumping mechanism or pressurized propellant; rather, the user needs only to squeeze the container in order to pressurize and dispense the fluid contents. Admittedly, the pressurization of the squeeze bottle contents is generally less than that achieved with a pump or in aerosol dispensers. This lower pressurization affects the spray pattern which one can achieve because many spray nozzles have a relatively high threshold pressure which must be achieved before the intended spray pattern can be formed therein. As a solution to this problem, a generation of fluidic oscillator nozzles have been developed which have very low threshold pressures and produce a wide variety of spray patterns (for example, see: U.S. Pat. No. 4,052,002; and my co-pending U.S. patent application Ser. No. 859,145, filed Dec. 9, 1977 and entitled "Fluidic Oscillator And Spray-Forming Chamber"). Although these fluidic oscillator nozzles are functionally much better suited to low pressure applications than conventional shear and spin nozzles, they are no more advantageous from a parts quantity point of view. That is to say, a separate member, or a projected member portion, is usually required to form the nozzle.

It is an object of the present invention to provide a nozzle arrangement which does not require additional structure or extended portions of existing structure yet which operates at relatively low pressures and is suitable for use with squeeze bottles.

It is another object of the present invention to make optimum use of existing structure in providing a nozzle for squeeze bottles.

SUMMARY OF THE INVENTION

In accordance with the present invention, a fluidic oscillator nozzle is defined in the top inner surface of a container cap and is sealed by a gasket which is urged against that surface when the container interior is pressurized. Alternatively, the nozzle may be formed in the gasket and sealed by the container cap.

BRIEF DESCRIPTION OF THE DRAWINGS

The above and still further objects, features and advantages of the present invention will become apparent upon consideration of the following detailed description of one specific embodiment thereof, especially when taken in conjunction with the accompanying drawings, wherein.

DESCRIPTION OF THE PREFERRED EMBODIMENTS

Figure 1:
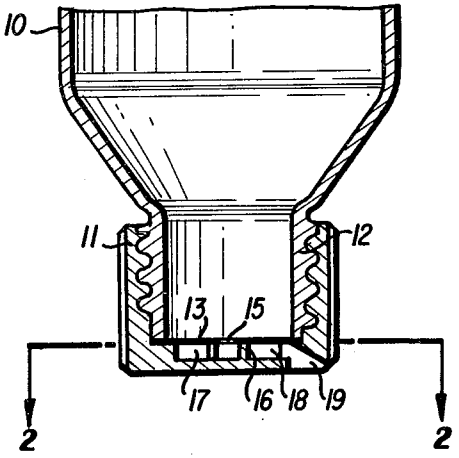
FIG. 1 is a side view in section of the top of a container and cap therefor in which the nozzle arrangement of the present invention is embodied.
Figure 2:
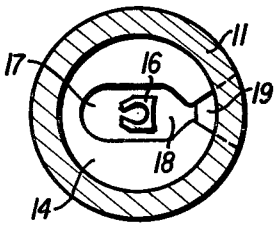
FIG. 2 is a view in section taken along lines 2—2 of FIG. 1.

Referring to FIGS. 1 and 2, a squeeze bottle (shown inverted) or other fluid container having resilient walls, is designated by the numeral 10. A cap 11 threadedly engages a threaded neck portion 12 of the container. Neck portion 12 makes annular contact at its upper rim with a gasket 13 which is positioned in abutting relation with the top inner surface 14 of cap 11. A small hole 15 is defined through the center of the gasket. Gasket 13 is preferably made of some soft sealing material such as flexible plastic or rubber.

A fluidic oscillator is defined by recesses in surface 14, inwardly of the neck portion 12 of container 10. The particular oscillator illustrated in FIGS. 1 and 2 is described and illustrated in detail in my aforementioned U.S. patent application Ser. No. 859,145; however, it is to be understood that substantially any fluidic oscillator can be used in its place for purposes of the present invention. The oscillator includes a power nozzle or other jet-forming structure 16 which is positioned in alignment with gasket hole 15 to receive fluid therefrom when container 10 is inverted as shown in FIG. 1. Nozzle structure 16 has a single opening which issues a jet of fluid into an oscillation chamber 17. The jet strikes the far wall of chamber 17 and divides into two alternating vortical flow paths which alternately issue fluid pulses out of the chamber 17, along the sides of nozzle structure 16, and into an output chamber 18. In the output chamber the fluid forms a vortex flow pattern which alternately spins clockwise and counterclockwise as the alternating input pulses are received. An outlet opening 19 formed in cap 12 issues the fluid from chamber to ambient in a generally fanshaped spray pattern having an angle and droplet distribution which depend on the particular configurations of chambers 17 and 18.

Container 10 is a squeeze bottle, or the like, from which liquid or other fluid may be dispensed by simply compressing the walls of the container. In operation, the container is inverted, as shown in FIG. 1, and squeezed to pressurize the fluid contents. The pressure urges gasket 13 against surface 14 of cap 11 to effect a tight fluid seal for the fluidic amplifier. In addition, pressurized fluid is forced from the container through gasket hole 15 into the oscillator. Oscillation proceeds in the manner described above and the oscillating spray is issued into ambient via outlet 19.

For most practical situations, the embodiment of FIGS. 1 and 2 is limited to holding container 10 inverted. Sometimes, however, it is desirable to employ a squeeze bottle when held upright. The embodiment of FIGS. 3 and 4 satisfies this requirement. A squeeze bottle 20 is provided with a cap 21 which threadedly engages the bottle neck 22. A generally mushroom-shaped gasket 23 is wedged into cap 21 with the top surface of the gasket abutting the top inner surface of the cap. A fluidic oscillator 24, for example, of the general type described in relation to FIG. 2, is defined as recesses in the top surface of gasket 23. The gasket 23 includes a depending stem portion 25 extending downwardly into bottle neck 22. Stem 25 has a cylindrical bore defined therein into which a dip tube 26 is forced. The dip tube 26 extends to the bottom of container 20 and provides a flow communication from the container to fluidic oscillator 24 through gasket 23. The tight wedging of gasket 23 against cap 21 will, for most applications, provide an adequate fluid seal for oscillator 24. In addition, however, pressurization of the container interior by squeezing the container walls results in gasket 23 being further urged against the cap for an even stronger seal. In addition, pressurization of the container interior forces the fluid contents up through dip tube 26 into oscillator 24 from which it is sprayed to ambient through a suitably provided outlet opening 27 defined through cap 21.

Figure 3:
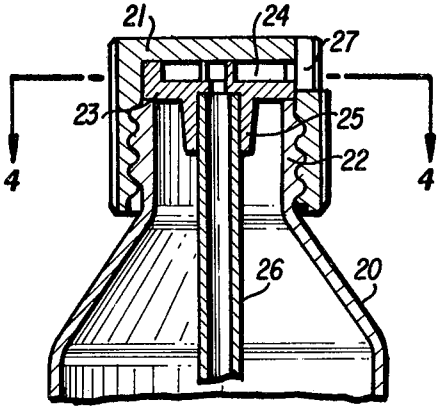
FIG. 3 is a side view in section of the top of a container and cap therefor in which another nozzle arrangement of the present invention is embodied.
Figure 4:
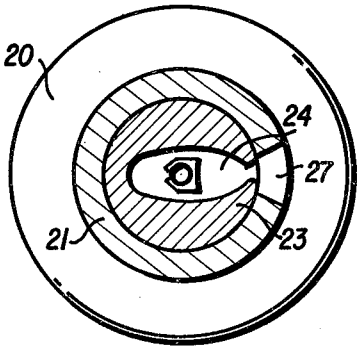
FIG. 4 is a view in section taken along lines 4—4 of FIG. 3.
Figure 5:
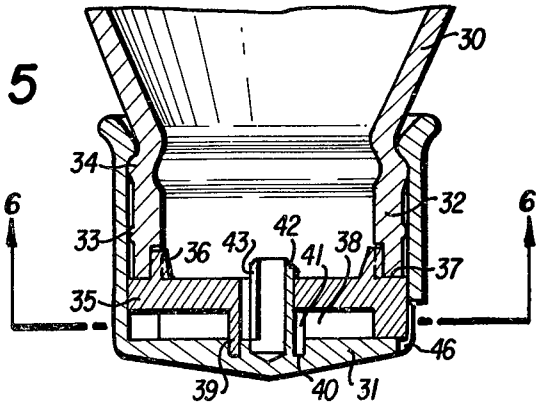
FIG. 5 is a side view in section of the top of a container and cap therefor in which still another nozzle arrangement of the present invention is embodied.
Figure 6:
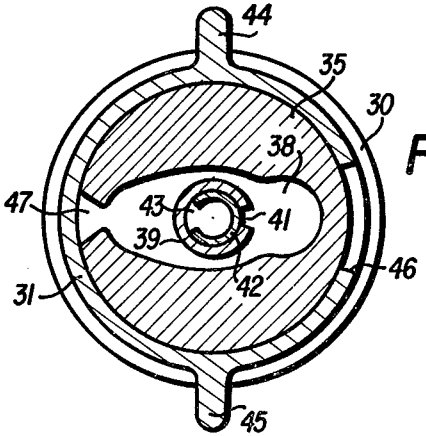
FIG. 6 is a view in section taken along lines 6—6 of FIG. 5.
Figure 7:
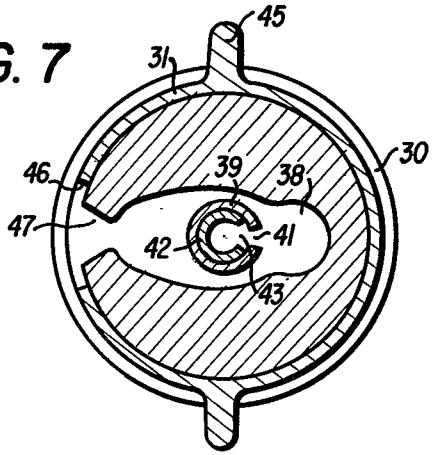
FIG. 7 is a view similar to that of FIG. 6 but showing the nozzle rotated by 180°.

The embodiments of FIGS. 1 and 3 do not provide a means for closing of nozzle arrangement to prevent against accidental or inadvertent spillage. A suitable closure for this purpose is illustrated in the embodiment of FIGS. 5, 6 and 7. Specifically, a squeeze container or bottle 30 (shown inverted) includes a neck portion 32 having spaced annular ribs 33 and 34 projecting radially outward. A gasket member 35 includes an annular projection 36 extending downwardly from its normally bottom surface at a location somewhat inward from the gasket periphery to leave an annular shoulder 37 between projection 36 and the periphery. The outside diameter of projection 36 is slightly greater than the inside diameter at the end of bottle neck 32 so that projection 36 can be wedged into the bottle neck.

A fluidic oscillator 38, for example, of the type described in relation to FIG. 2, is defined in the surface of gasket 35 opposite projection 36. Oscillator 38 is sealed by the inner surface of a cap 31 which has resilient sides extending down along bottle neck 32. The inner surface of the resilient sides of cap 31 is contoured to engage lower annular rib 34 on the bottle neck in a snap fit arrangement. In this position cap 31 is free to rotate about bottle neck 32 and gasket 35 with annular ribs 33 and 34 serving as bearings for the cap.

The power nozzle structure for oscillator 38 includes a generally annular upstanding member 39 which is integral with gasket 35 and extends into an annular recess 40 defined in the sealing surface of cap 31. A narrow slit 41 is defined along the length of member 39 and serves as the jet-forming means for the nozzle structure. A tube 42, formed integrally with cap 31, is concentrically journaled inside member 39 and is provided with a lengthwise-extending cut-away portion 43. When cap 31 is rotated about bottle neck 32, tube 42 rotates concentrically within member 39. Tube 42 may extend only a short way into bottle 30 (as illustrated in FIG. 5) or it may extend to the bottom of the bottle to serve the same function as dip tube 26 of FIG. 3. In the former case, the container is used primarily when inverted; in the latter case, the container is used in an upright position and cut-away portion 43 extends only along that part of tube 42 which is within the oscillator element. A pair of 180°-spaced projections extend outwardly from cap 31 to facilitate rotation of the cap. An outlet opening 46 is defined through one side of cap 31.

In operation, in the position of cap 31 illustrated in FIG. 6, slit 41 of member 39 is disposed 180° opposite the position of cut-away portion 43 of tube 42. Likewise, the output opening 47 of oscillator 38 is positioned 180° opposite the outlet opening 46 in cap 31. In this position pressurized fluid entering tube 42 is blocked from entering oscillator 38 due to the mis-alignment of slip 41 and cut-away 43. Likewise, residue fluid in oscillator 38 is blocked from egressing to ambient by the mis-alignment of oscillator output opening 47 and outlet opening 46. If the cap is rotated 180° to the position shown in FIG. 7, slit 41 and cut-away 43 are aligned, permitting pressurized fluid from the squeezed container 30 to enter oscillator 38 via tube 42. The oscillating fluid is permitted to spray into ambient because outlet opening 46 in cap 31 is also aligned with output opening 47 of the oscillator.

Thus by rotating cap 31, one is able to selectively close or open the nozzle. Suitable detents and/or position indicators for cap 31 may be provided in a conventional manner.

Figure 9:
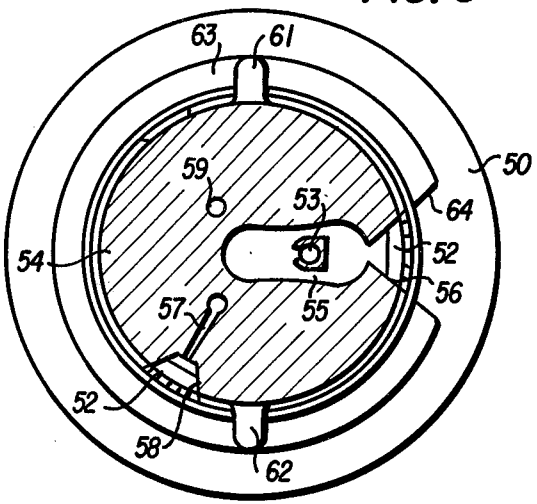
FIG. 9 is a view in section taken along lines 9—9 of FIG. 8.
Figure 8:
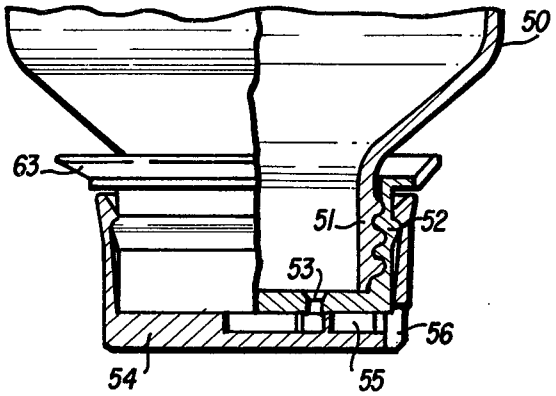
FIG. 8 is a side view in partial section of the top of a container and cap therefor in which yet another nozzle arrangement is embodied according to the present invention.
Figure 10:
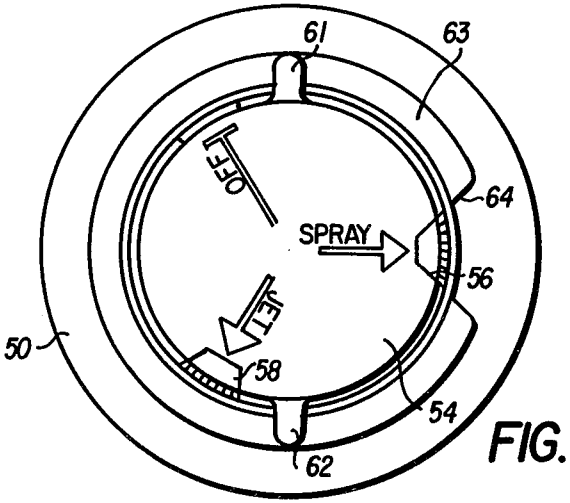
FIG. 10 is a view in plan of the top of the container and cap of FIG. 8.

Another embodiment of the invention is illustrated in FIGS. 8, 9, and 10. A container 50 has a threaded neck portion 51 which is engaged by a threaded inner cap 52. A through-hole 53 is defined through inner cap 52 at a location radially offset from the cap center. An outer cap 54 is arranged to snap-fit over inner cap 53 and has a fluidic oscillator 55 defined as a recessed part of its inner surface which abuts the top of inner cap 52. Oscillator 55 has its power nozzle structure positioned at the same radial distance from the cap center as the distance of through-hole 53 from the cap center. Therefore, the oscillator power nozzle can be aligned with through-hole 53 for a particular angular position of cap 54. An outlet opening 56 to ambient for oscillator 55 is defined through outer cap 54.

A nozzle 57 is defined as a recess in the same surface of outer cap 54 as oscillator 55 but is angularly spaced from the oscillator by 120°. A tapered nozzle 57 is also radially positioned to be alignable with through-hole 53 for a specific angular position of cap 54. Tapered nozzle 57 is configured to form a straight jet of pressurized fluid and includes an outlet opening 58 to ambient defined through outer cap 54.

At a location angularly spaced by 120° from both oscillator 55 and nozzle 57, there is a shallow recess 59 projecting inwardly into the same surface of outer cap 54 as that in which oscillator 55 and nozzle 57 are defined. Recess 59 is located radially so as to align with through-hole 53 which has a projecting rim that cooperates with the recess to serve a detent function in the OFF position.

A pair of projections 61, 62 extend radially outward from outer cap 54 to facilitate rotation of that cap. Inner cap 52 is provided with an annular flange 63 which projects radially outward from a location below the lowermost extremity of outer cap 54. A notch 64 or cut-away section is provided in flange 63 to serve as a position index. Indicators imprinted on the top surface of outer cap 54 cooperate with notch 64 to provide an indication of proper positioning of cap 54 to achieve the desired operating mode. Specifically, an arrow designated SPRAY is oriented to point radially outward toward notch 64 when the position of cap 54 places the nozzle structure of oscillator 55 in alignment with through-hole 53. An arrow marked JET is oriented to point radially outward toward notch 64 when the position of cap 54 places nozzle 57 is alignment with through-hole 53. A further marker designated OFF is arranged to be aligned with notch 64 when recess 59 is aligned with through-hole 53.

From the foregoing description it is seen that the embodiment of FIGS. 8, 9 and 10 is capable of operating in any of three modes. In the SPRAY mode, oscillator 55 issues a swept jet through outlet 56 in response to squeezing of container 50 to provide a generally fan-shaped spray pattern. In the JET mode, nozzle 57 issues a straight jet through outlet 58. In the OFF mode, no fluid can egress from the container.

Caps 52 and 54 are made of a semi-flexible material, such as polypropylene. Although the embodiment of FIG. 8 is shown as requiring inversion to operate, it is clear that by providing a dip tube at through-hole 53, upright operation may be achieved. For purposes of this embodiment, inner cap 51 may be considered as serving the function of the gasket 13 of FIG. 1.

Figure 11:
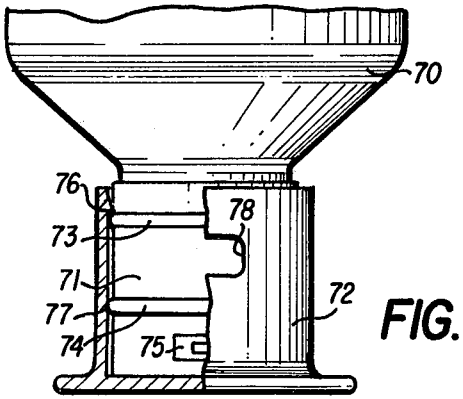
FIG. 11 is a side view in partial section showing still another embodiment of the present invention.

Referring to FIG. 11, another embodiment of the invention includes a squeeze bottle 70 and inner cap 71 in which a fluidic oscillator (not shown) is formed in a manner similar to that shown in FIG. 1, for example. Cap 71 includes two annular ribs 73, 74 projecting radially outward from its outer surface, rib 74 being the closer rib to the top of cap 71. An outlet opening 75 for the fluidic oscillator is defined through cap 71 at a location between rib 74 and the top of the cap. An outer cap 72 includes a lip 76 which engages rib 73 in snap-fit engagement. In this position, rib 74 resides in an annular channel 77 defined in the inner surface of cap 72. Cap 72 may be longitudinally re-positioned along cap 71 so that lip 76 engages rib 74 instead of rib 73. In this position, an outlet opening 78, defined through cap 72, is aligned with oscillator outlet opening 75 defined in cap 71 so that flow may egress from cap 72 when bottle 70 is squeezed. In the previously-described position, wherein lip 76 engages rib 73 (as shown in FIG. 11), any liquid escaping from outlet 75 is trapped by rib 74 and channel 77 so that it cannot escape to ambient. This cap arrangement therefore serves as a convenient cover to prevent inadvertent leakage from the bottle during shipping or storage.

As mentioned above, the invention described in the various embodiments is not limited to the use of the particular oscillator shown. Substantially any fluidic oscillator can be employed. In addition, the specific oscillator shown has been described as delivering a fan-shaped spray pattern; however, it is to be understood that substantially any spray pattern configuration, which is attainable with a fluidic oscillator, may be issued. Although the fluid intended to be dispensed is in most cases liquid, the principle of the invention applies equally as well to dispensing gases, foams, particulate-laden liquids or gases, and combinations of these.

While I have described and illustrated various specific embodiments of my invention, it will be clear that variations of the details of construction which are specifically illustrated and described may be resorted to without departing from the true spirit and scope of the invention as defined in the appended claims.

I claim:

1. A squeeze bottle dispenser for fluid material comprising:

a container for fluid, said container having a neck portion and a movable wall portion which is adapted to be squeezed by the hand of the user;

a cap engaging said neck portion, said cap having at least a first interior surface disposed proximate the end of said neck portion;

gasket means interposed between said first surface and fluid contents of said container, said gasket means including a second surface positioned in abutting relation with said first surface such that said first and second surfaces are urged together when the contents of said container are pressurized in response to squeezing of said wall portion;

a fluidic oscillator nozzle defined as a recessed portion of one of said first and second surfaces, the other of said surfaces comprising a sealing means for said fluidic oscillator;

ingress means for conducting fluid from said container under pressure through said gasket means to said fluidic oscillator nozzle; and outlet opening means defined through said cap for conducting outflow from said fluidic oscillator nozzle to ambient.

2. The dispenser according to claim 1:

wherein said fluidic oscillator nozzle is defined in said first surface; and wherein said ingress means is a through-hole defined through said gasket means.

3. The dispenser according to claim 1:

wherein said fluidic oscillator nozzle is defined in said second surface; and wherein said ingress means comprises a supply tube extending from the bottom of said container and through said gasket means to said fluidic oscillator.

4. The dispenser according to claim 1 wherein said cap is manually rotatable relative to said gasket means to rotatably slide said first and second surfaces relative to one another.

5. The dispenser according to claim 4:

wherein said fluidic oscillator has an output channel for issuing oscillating pressurized fluid therefrom;

wherein for at least a first rotational position of said cap said output channel is aligned with said outlet opening means to permit outflow from said fluidic oscillator to be issued to ambient; and wherein for at least a second rotational position of said cap said output channel is misaligned with said outlet opening means to block outflow from said fluidic oscillator to ambient.

6. The dispenser according to claim 5 wherein said fluidic oscillator includes an inflow opening and further comprising means for passing fluid from said ingress means to said inflow opening when said cap is in said first rotational position and for blocking fluid flow from said ingress means to said inflow opening when said cap is in said second rotational position.

7. The dispenser according to claim 4, 5 or 6 further comprising nozzle means for forming a straight jet defined as a recessed portion in said one of said first and second surfaces and sealed by the other of said surfaces, wherein for at least one rotational position of said cap said nozzle means is aligned with said ingress means to receive fluid therefrom and with said outlet opening means to issue said straight jet to ambient.

8. The dispenser according to claim 5 or claim 6:

wherein said fluidic oscillator nozzle is defined in said first surface; and wherein said ingress means is a through-hole defined through said gasket means.

9. The dispenser according to claim 5 or 6 wherein said fluidic oscillator nozzle is defined in said second surface.

10. The dispenser according to claim 7:

wherein said fluidic oscillator nozzle is defined in said first surface; and wherein said ingress means is a through-hole defined through said gasket means.

* * * * *